United States Patent [19]

Dobbin

[11] 4,321,096

[45] Mar. 23, 1982

[54] APPARATUS AND METHOD FOR CLEANING AN EXPLOSION SENSING PORT

[75] Inventor: Robert R. Dobbin, Webster, N.Y.

[73] Assignee: John B. Pike & Son, Inc., Rochester, N.Y.

[21] Appl. No.: 217,086

[22] Filed: Dec. 16, 1980

[51] Int. Cl.[3] ..... B08B 9/02

[52] U.S. Cl. ..... 134/8; 15/104.05; 15/104.16; 134/18; 241/31

[58] Field of Search ..... 134/8, 18; 15/104.05, 15/104.16; 241/31, 166; 116/266; 73/863.24, 863.81, 863.86

[56] References Cited

U.S. PATENT DOCUMENTS 2,020,241 11/1935 Dimmig ..... 15/104.05 X
2,380,098 7/1945 Doerner ..... 15/104.05 UX
2,783,845 3/1957 Mathisen ..... 241/31 X
3,143,302 8/1964 Carlson et al. ..... 134/8 X
3,912,015 10/1975 Garbee et al. ..... 241/31 X

*Primary Examiner*—Marc L. Caroff
*Attorney, Agent, or Firm*—Cumpston & Shaw

[57] ABSTRACT

A bar is intermittently movable through an explosion sensing port in the wall of a chamber for cleaning the port without blocking it. The chamber is coupled to a mechanism for introducing a suppression agent into the chamber for suppressing or smothering an explosion within the chamber, and further has a pressure responsive device for actuating the explosion suppressing mechanism whenever the fluid pressure sensed through the sensing port reaches a predetermined value due to an explosion within the chamber. A duct fluidly connects the sensing port to the pressure responsive device, and the bar is movably mounted within a portion of the duct.

14 Claims, 3 Drawing Figures

APPARATUS AND METHOD FOR CLEANING AN EXPLOSION SENSING PORT

BACKGROUND OF THE INVENTION

1. Field of the Invention

The present invention relates to port cleaning apparatus, and more particularly to an apparatus and method for cleaning an explosion sensing port in the wall of a chamber, and maintaining the port open so that fluid pressure within the chamber can be continuously sensed through the port.

2. Description of the Prior Art

It is known in the art to provide shredding equipment, for example, having a chamber within which an explosive mixture can accumulate. Such chambers are provided with explosion suppression means coupled thereto which, when actuated, release a pressurized suppression agent or the like into the chamber for suppressing or smothering the explosion. The chamber has one or more sensing ports extending through a wall thereof, and a fluid pressure detector fluidly connected to the port. The detector senses an increase in fluid pressure through the port when an explosion occurs, and in response thereto actuates the explosion suppression means which suppresses or smothers the explosion.

A problem with the aforementioned explosion suppression system is that the sensing port may get plugged with shredded material or the like within the chamber, thereby blocking the passage of fluid pressure through the port. As a consequence, the detector and the explosion suppression means are not actuated by any fluid pressure increase within the chamber resulting from an explosion. Accordingly, the explosion is unsuppressed with possible disastrous results. The present invention overcomes this problem by providing a novel apparatus and method for preventing the sensing port from becoming blocked.

SUMMARY OF THE INVENTION

A primary object of the present invention is to provide a novel apparatus and method for intermittently cleaning an explosion sensing port in the wall of a chamber without blocking the port so that fluid pressure within the chamber can be continuously sensed through the sensing port.

In one aspect of the invention, the apparatus comprises bar means movable through the sensing port for cleaning out any material that has accumulated in the sensing port. The bar means has a cross-sectional area that is less than the cross-sectional area of the port to provide clearance spaces therebetween to allow fluid pressure to pass therethrough while the port is being cleaned. Means are provided for intermittently moving the bar means through the port, preferably in timed sequence.

In more specific aspects of the invention, the sensing port has a circular cross-section, and the bar means has a non-circular cross-section, such as square, for example. The bar moving means comprises a fluid cylinder coupled to the bar means. Duct means are provided for fluidly coupling the sensing port to the pressure responsive means. The bar means is mounted for reciprocal movement within a portion of the duct means.

A primary advantage of the present invention is to eliminate blocking of a sensing port or ports in a chamber so that any explosion within the chamber can be immediately sensed, and mechanism actuated to suppress or smother the explosion.

The invention and its advantages will become more apparent from the detailed description of the invention presented below.

BRIEF DESCRIPTION OF THE DRAWINGS

In the detailed description of the invention presented below, reference is made to the accompanying drawings, in which.

DETAILED DESCRIPTION OF THE INVENTION

Figure 1:
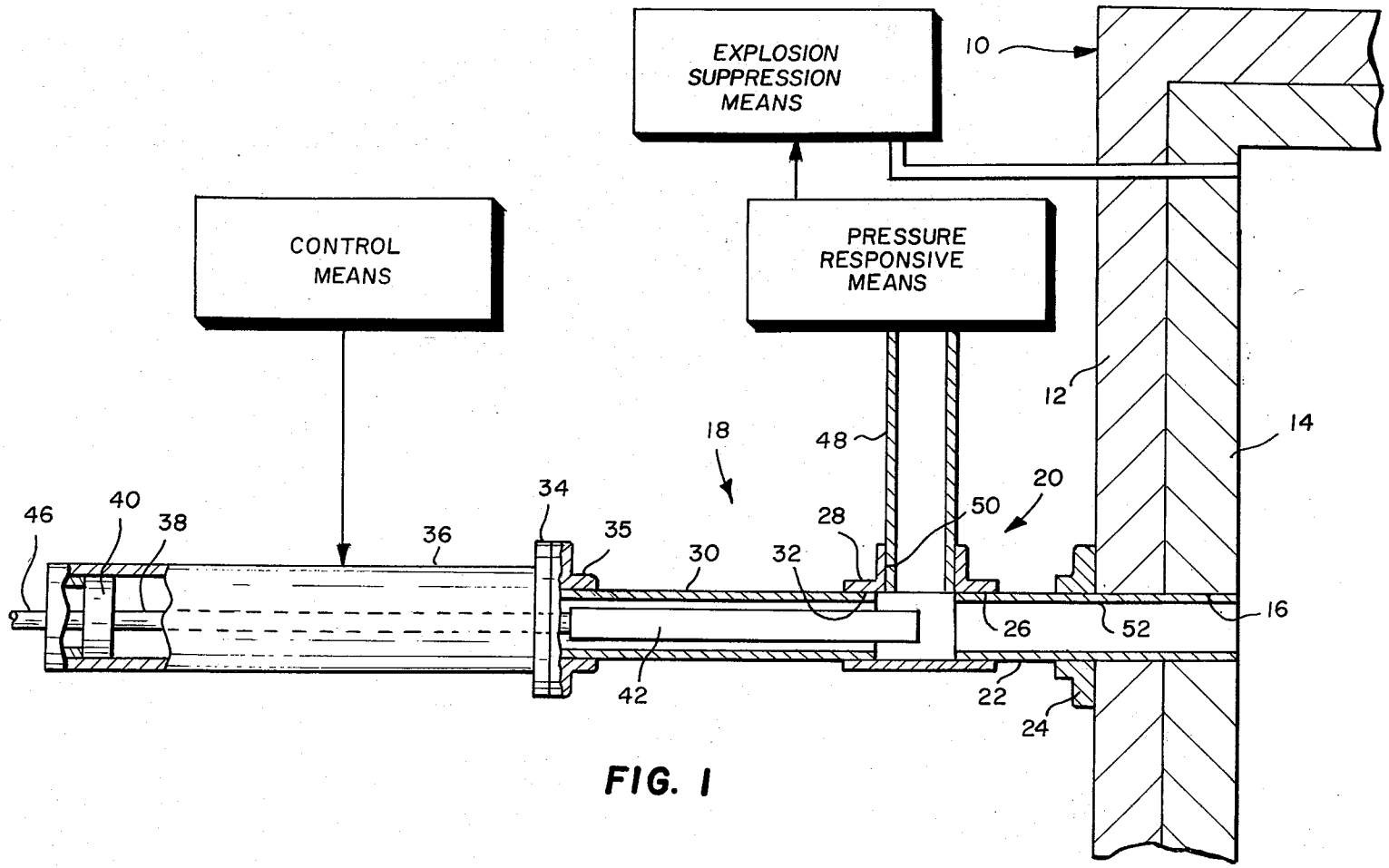
FIG. 1 is a segmental side elevational view partially in section of a preferred embodiment of the port cleaning apparatus of this invention in a retracted non-cleaning position.
Figure 2:
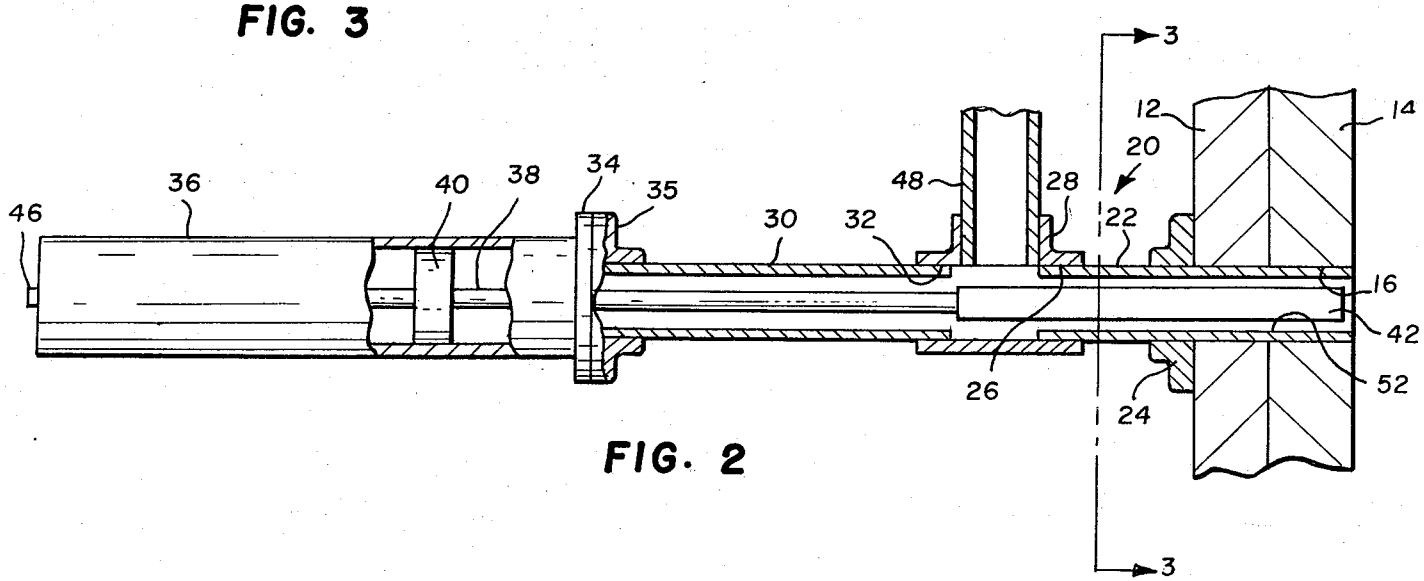
FIG. 2 is a view similar to FIG. 1 showing the apparatus in an extended port cleaning position.

With reference to FIGS. 1 and 2, a preferred embodiment of the present invention is shown coupled to an enclosed chamber 10, only a segment of which is shown, of an apparatus of the type in which an explosive mixture can accumulate, and an explosion can occur. One such apparatus, not shown, is a shredding apparatus, for example, of the type used in a resource recovery installation.

In a shredding apparatus of the type mentioned, chamber 10 has an outer wall 12 and an inner protective liner 14 of any suitable material. The wall 12 and liner 14 are provided with one or more ports 16 extending therethrough, only one of which is shown. In such apparatus, port 16 is fluidly coupled to a pressure responsive means of any suitable type, such as a fluid pressure switch, shown in block form in FIG. 1. The pressure responsive means, in turn, is coupled to explosion suppression means of any suitable type appropriately located adjacent chamber 10, and shown in block form, which emits a suppressing agent into the chamber for suppressing or smothering an explosion sensed by the pressure responsive means. In essence, any explosion within chamber 10 immediately generates a pressure within the chamber which is sensed through port 16 by the pressure responsive means and is actuated thereby to trigger the explosion suppression means.

A sensing port cleaning apparatus, indicated generally by the number 18, is provided in conjunction with the pressure responsive means to guarantee that the pressure within chamber 10 is continuously sensed by the pressure responsive means. The port cleaning apparatus 18 comprises a T-shaped duct means 20, one leg of which comprises a round pipe 22 having one end inserted through pot 16 and sealingly secured to chamber wall 12 by a flange 24. The opposite pipe end is secured to an opening 26 in a T-shaped coupling 28.

Another leg of the duct means 20 comprises a round pipe 30 similar to pipe 22 and mounted in alignment therewith. Pipe 30 has one end secured to opening 32 in coupling 28, and the other pipe end sealingly secured by a flange 35 to the head end 34 of a fluid cylinder 36 such as an air cylinder. The cylinder 36 encircles a cylinder rod 38 operated by and secured to a piston 40 slidably mounted within the cylinder.

A non-circular bar 42, such as a square bar with chamfered edges 44 (FIG. 3), is secured to an end of rod 38. In the normal retracted position of the air cylinder, piston 40 is enclosed by pipe 30 and a portion of coupling 28 as seen in FIG. 1. In this normal retracted position, a cylinder rod 46 secured to the opposite side of piston 40 extends outwardly from the cylinder to visibly indicate the cylinder piston position and detect any malfunction thereof.

The duct means 20 further comprises another leg in the form of a round pipe 48 having one end secured to opening 50 in coupling 28, and its opposite end fluidly connected to the fluid pressure responsive means depicted in block form.

When the air cylinder 36 is operated, piston 40 is moved to its extended cleaning position as shown in FIG. 2. In this extended position, bar 42 is moved through pipe 22 and port 16 cleaning out any shredded material or the like that may have accumulated within pipe 22. This assures that the pressure within chamber 10 will continuously pass through pipes 22, 48 and be sensed by the pressure responsive means. Also, only the end of rod 46 will be visible denoting that the cylinder piston 40 is in its extended position and functioning properly.

Figure 3:
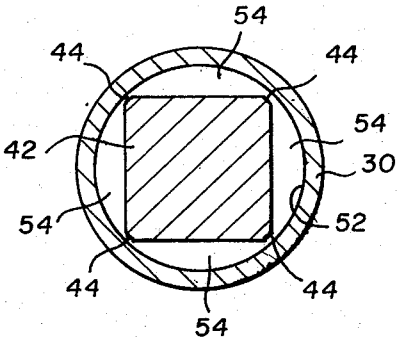
FIG. 3 is a section view taken substantially along line 3—3 of FIG. 2.

With reference to FIG. 3, the opening 52 in pipe 22 is shown as having a circular cross-section whereas bar 42 has a non-circular, substantially square cross-section. The chamfered edges 44 of the bar are spaced a few thousands of an inch from the inner surfaces of pipes 22, 30 to provide sufficient clearance therebetween to allow reciprocal movement of the bar within the pipes without binding. By virtue of the circular and non-circular cross-sections, clearance spaces 54 exist therebetween at all times to provide fluid passages for fluid pressure within chamber 10 even when bar 42 is in its extended cleaning position.

It is, of course, understood that other non-circular, cross-sectional shapes for bar 42 can be used such as triangular or rectangular, for example. Also, it is possible to reverse the cross-sectional shapes; that is, have the openings in pipes 22, 30 provided with a non-circular cross-section such as triangular, for example, and bar 42 provided with a circular cross-section. The main requirement is that the cross-section of the pipe opening 52 and bar 42 be different so that clearance spaces 54 will exist therebetween throughout the full length of the bar. To provide adequate clearance spaces 54, it is believed that the cross-sectional area of bar 42 should be roughly two-thirds of the cross-sectional area of pipe opening 52.

A control means of any suitable type known in the art and depicted in block form is coupled to air cylinder 36 for operating the air cylinder between its normal retracted and extended positions. The control means includes any known type of sequence timer for operating the air cylinder in a selected timed sequence for adjustably varying the time of each port cleaning stroke as well as the time between strokes. Although only one port 16 and one port cleaning apparatus 18 is shown in the drawings, it should be understood that preferably a plurality of ports and port cleaning apparatuses will be incorporated in each chamber 10 and operated in timed sequence by the control means.

While a presently preferred embodiment of the invention has been shown and described with particularity, it will be appreciated that various changes and modifications may suggest themselves to one having ordinary skill in the art upon being apprised of the present invention. It is intended to encompass all such changes and modifications as fall within the scope and spirit of the appended claims.

What is claimed is:

1. In an apparatus for cleaning an explosion sensing port in the wall of a chamber without blocking said port, in which said chamber is coupled to an explosion suppression means, and has pressure responsive means fluidly coupled to said explosion sensing port for actuating said explosion suppression means whenever the fluid pressure through said sensing port reaches a predetermined value due to an explosion within the chamber, the improvement comprising:

bar means movable through said sensing port for cleaning out any material that has accumulated in said sensing port, said bar means having a cross-sectonal area throughout its length that is less than the cross-sectional area of said sensing port to provide clearance spaces therebetween for allowing fluid pressure to pass through said sensing port while it is being cleaned; and means coupled to said bar means for intermittently moving said bar means.

2. The sensing port cleaning apparatus according to claim 1 wherein the cross-sectional area of said bar means is approximately two-thirds of the cross-sectional area of said sensing port.

3. The sensing port cleaning apparatus according to claim 1 wherein said sensing port has a circular cross-section, and said bar means has a non-circular cross-section.

4. The sensing port cleaning apparatus according to claim 3 wherein said non-circular cross-section is a substantially square cross-section.

5. The sensing port cleaning apparatus according to claim 1 wherein said bar moving means comprises a fluid operated cylinder having a first cylinder rod coupled to said bar means.

6. The sensing port cleaning apparatus according to claim 1, and further comprising duct means for fluidly coupling said sensing port to said pressure responsive means.

7. The sensing port cleaning apparatus according to claim 6 wherein said bar means comprises a bar, and said duct means comprises a T-shaped duct having a first opening of a first leg connected to said sensing port, a second opening of an aligned second leg connected to said bar moving means and encircling said bar, and a third opening of a third leg connected to said pressure responsive means.

8. The sensing port cleaning apparatus according to claim 7 wherein said first leg comprises a round pipe having said first opening extending through and sealed to said sensing port, and said second leg comprises a round pipe having said second opening sealingly connected to said bar moving means.

9. The sensing port cleaning apparatus according to claim 8 wherein said bar is non-circular and said bar moving means comprises a fluid cylinder having a first cylinder rod connected to said bar for reciprocally moving it along said first and second pipes into and out of said sensing port.

10. The sensing port cleaning apparatus according to claim 9 wherein said bar has a substantially square cross-section, said bar is reciprocally moved by said first fluid cylinder rod between a first position in which it nests within said second leg, and a second position in which it extends through said first leg and said sensing port for cleaning said sensing port, and further comprising a visible second rod connected to said cylinder opposite to and aligned with said bar and movable therewith to visibly indicate whether said bar is in said first or second position, and control means for intermittently operating said fluid cylinder in a predetermined timed sequence.

11. A method for cleaning an explosion sensing port in the wall of a chamber without blocking said port, in which said chamber is coupled to an explosion suppression means, and has pressure responsive means coupled to said explosion sensing port for actuating said explosion suppression means whenever the fluid pressure through said sensing port reaches a predetermined value due to an explosion within the chamber, comprising the steps of:

fluidly connecting said sensing port to said pressure responsive means by a duct means;

arranging a bar within a portion of said duct means for movement through said sensing port for cleaning out any material that has accumulated in said sensing port, said bar having a cross-sectional area throughout its length that is less than the cross-sectional area of said sensing port to allow fluid pressure to pass through said sensing port while it is being cleaned; and intermittently moving said bar through said sensing port.

12. A method for cleaning an explosion sensing port according to claim 11 wherein said sensing port is circular and said bar is non-circular, and said bar is moved through said sensing port by a fluid cylinder.

13. A method for cleaning an explosion sensing port according to claim 12 wherein said duct means is T-shaped and has a first leg having a first opening sealingly connected to said sensing port, an aligned second leg having a second opening sealingly connected to said fluid cylinder, and a third leg having a third opening sealingly connected to said pressure responsive means, and said bar is arranged for slidable movement within said first and second legs.

14. A method for cleaning an explosion sensing port according to claim 13 wherein said bar is intermittently moved through said sensing port in a timed sequence.

* * * * *